US009868287B2

(12) United States Patent
Ito et al.

(10) Patent No.: US 9,868,287 B2
(45) **Date of Patent: *Jan. 16, 2018**

(54) INK JET RECORDING APPARATUS AND METHOD FOR MAINTAINING THE SAME

(71) Applicant: Seiko Epson Corporation, Tokyo (JP)

(72) Inventors: Jun Ito, Shimosuwa (JP); Makoto Nagase, Shiojiri (JP); Kenichiro Kubota, Matsumoto (JP); Naoki Koike, Matsumoto (JP); Keiji Iida, Chikuhoku (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,759

(22) Filed: Mar. 9, 2016

(65) Prior Publication Data

US 2016/0263899 A1 Sep. 15, 2016

(30) Foreign Application Priority Data

Mar. 10, 2015 (JP) ..... 2015-046896

(51) Int. Cl.
*B41J 2/165* (2006.01)

(52) U.S. Cl.
CPC ..... *B41J 2/16535* (2013.01); *B41J 2/16552* (2013.01); *B41J 2/16517* (2013.01); *B41J 2002/1655* (2013.01)

(58) Field of Classification Search
CPC ..... B41J 2/16535; B41J 2/16552; B41J 2/16517; B41J 2002/1655
See application file for complete search history.

(56) References Cited

U.S. PATENT DOCUMENTS 6,440,925 B1 * 8/2002 Suazon ..... A61K 8/0208 424/404
8,162,436 B2 4/2012 Takahashi et al.
(Continued)

FOREIGN PATENT DOCUMENTS

EP 2 644 385 A1 10/2013
EP 2 682 269 A1 1/2014
(Continued)

*Primary Examiner* — Matthew Luu
*Assistant Examiner* — Yaovi M Ameh
(74) *Attorney, Agent, or Firm* — Harness, Dickey & Pierce, P.L.C.

(57) ABSTRACT

Provided is a method for maintaining an ink jet recording apparatus according to the invention in an ink jet recording apparatus which performs recording using a solvent-based ink composition which includes at least one type of organic solvent selected from a group consisting of an ester-based solvent, a hydrocarbon-based solvent, and an alcohol-based solvent, the method including wiping a nozzle forming member, in which nozzles of a head which discharges the solvent-based ink composition are formed, using an impregnation solution and a wiping member with liquid absorbency, in which the impregnation solution contains at least one type of organic solvent selected from a group consisting of a compound which is represented by General Formula (1) below, esters, and dibasic acid esters, $$R^1—O—(R^2—O)_n—R^3 \quad (1)$$

(in General Formula (1) described above, $R^1$ represents a hydrogen atom, an aryl group, or an alkyl group with 1 to 6 carbon atoms, $R^2$ represents an alkylene group with 2 to 4 carbon atoms, $R^3$ represents an aryl group or an alkyl group with 1 to 6 carbon atoms, and n represents an integer of 1 to 9).

16 Claims, 3 Drawing Sheets

(56) References Cited

U.S. PATENT DOCUMENTS

| | | | | |
|---|---|---|---|---|
| 9,199,469 | B1 * | 12/2015 | Ito | B41J 2/16535 |
| 2006/0252324 | A1 * | 11/2006 | Julemont | A47L 13/16<br>442/97 |
| 2010/0126529 | A1 * | 5/2010 | Seki | B41J 2/16552<br>134/22.1 |
| 2010/0273695 | A1 * | 10/2010 | Sehgal | C08G 65/3314<br>510/174 |
| 2014/0011942 | A1 * | 1/2014 | Hosoya | C09D 11/36<br>524/504 |
| 2014/0085376 | A1 * | 3/2014 | Kato | B41J 2/16552<br>347/33 |
| 2014/0107007 | A1 * | 4/2014 | Sao | B41J 2/16552<br>510/170 |

FOREIGN PATENT DOCUMENTS

| | | | |
|---|---|---|---|
| JP | 2001-260368 | A | 9/2001 |
| JP | 2005-111808 | A | 4/2005 |
| JP | 2009-101630 | A | 5/2009 |
| JP | 2010-274533 | A | 12/2010 |
| JP | 2013-132753 | A | 7/2013 |

* cited by examiner

INK JET RECORDING APPARATUS AND METHOD FOR MAINTAINING THE SAME

BACKGROUND

1. Technical Field

The present invention relates to a method for maintaining an ink jet recording apparatus and an ink jet recording apparatus which is able to carry out the same.

2. Related Art

In the related art, so-called ink jet recording apparatuses which record images or characters using minute ink droplets which are discharged from nozzles of an ink jet recording head are used. As the inks which are used by the ink jet recording apparatuses for recording images or the like, various types of inks are used such as water-based inks where coloring materials (for example, pigments or dyes) are dissolved or dispersed in a mixture of an organic solvent and water, solvent-based inks where coloring materials are dissolved or dispersed in an organic solvent, and the like.

Among the inks, solvent-based inks which have a glycol ether-based solvent as a base are widely used from the point of view of being able to record excellent images with favorable dryness and water resistance on recording media with ink low absorbency (for example, vinyl chloride films). In addition, solvent-based inks which have an ester-based solvent or a hydrocarbon-based solvent as a base are also widely used from the point of view of having excellent dryness although there are difficulties in terms of the odor and, moreover, solvents with higher boiling points are also used for plain paper as solvent-based inks with low volatility.

Here, in a case of using an ink jet recording apparatus, inks may be attached to nozzle forming members in which nozzles are provided. The inks which are attached to the nozzle forming member may be thickened or solidified due to moisture or other volatile components included therein being evaporated. In addition, there are cases where fiber waste or paper powder coming from recording media such as paper or fabric is attached to the nozzle forming members. In this manner, normal ink discharging may be blocked when foreign matter such as inks, paper, fibers, and dust is attached to nozzles or in the vicinity of the nozzles.

With respect to the discharge failure problems, for example, JP-A-2001-260368 discloses using a cleaning cloth as cleaning means in order to remove ink droplets which are attached to the nozzle forming member. In addition, JP-A-2009-101630 discloses performing wet wiping after coating a recording head or rubber wiper with a wet liquid. JP-A-2010-274533 discloses absorbing inks which are attached to the nozzle forming member using a rolled cleaning cloth or wetting the cleaning cloth using a cleaning liquid. Furthermore, JP-A-2013-132753 discloses supplying a liquid from a liquid supply section to a wiping surface of a cleaning member. Due to this, it is possible to suppress drying of the discharge surface, prevent inks on the discharge surface from being solidified, and easily wipe off the inks. In addition, it is possible to easily wipe off even inks solidified or thickened inks by drying.

However, in the method for cleaning the nozzle forming member described in JP-A-2001-260368, the nozzle forming member may be damaged or the cleaning may be insufficient since a liquid is not used to clean the nozzle forming surface. In addition, in the method for cleaning the nozzle forming member described in JP-A-2009-101630, the cleaning of the nozzle member may be insufficient or the nozzle forming member may be damaged since a rubber wiper is used for the cleaning.

On the other hand, while it is possible to record excellent images with solvent-based inks as described above, solvent-based inks have a problem of being difficult to remove when attached to the nozzle forming member. For this reason, there is a problem in that it is not possible to sufficiently remove the solvent-based inks which are attached to the nozzle forming member even when the nozzle forming member is cleaned using the cleaning liquids (liquid) described in JP-A-2010-274533 and JP-A-2013-132753. In particular, depending on the compatibility between the cleaning liquid (liquid) and the solvent-based inks, ink discharge failures may be generated despite cleaning the nozzle forming member due to satisfactory cleanness not being obtained or components which are included in the solvent-based inks being aggregated.

SUMMARY

An advantage of some aspects of the invention is that it provides a method for maintaining an ink jet recording apparatus which solves at least some of the problems described above, obtains excellent cleanness and suppresses the aggregation of solvent-based inks in a nozzle forming member of the ink jet recording apparatus, and is also suitable for long-term storage environments, and an ink jet recording apparatus able to carry out the maintaining method.

The invention can be realized in the following aspects or application examples.

Application Example 1

According to an aspect of the invention, there is provided a method for maintaining an ink jet recording apparatus which performs recording using a solvent-based ink composition which includes at least one type of organic solvent selected from a group consisting of an ester-based solvent, a hydrocarbon-based solvent, and an alcohol-based solvent, the method including wiping a nozzle forming member, in which nozzles of a head which discharges the solvent-based ink composition are formed, using an impregnation solution and a wiping member with liquid absorbency, in which the impregnation solution contains at least one type of organic solvent selected from a group consisting of a compound which is represented by General Formula (1) below, esters, and dibasic acid esters, $$R^1—O—(R^2—O)_n—R^3 \quad (1)$$

(in General Formula (1) described above, $R^1$ represents a hydrogen atom, an aryl group, or an alkyl group with 1 to 6 carbon atoms, $R^2$ represents an alkylene group with 2 to 4 carbon atoms, $R^3$ represents an aryl group or an alkyl group with 1 to 6 carbon atoms, and n represents an integer of 1 to 9).

In the method for maintaining an ink jet recording apparatus of Application Example 1, excellent cleanness may be obtained and the aggregation of solvent-based inks may be suppressed in the nozzle forming member of the ink jet recording apparatus and the method may also be suitable for long-term storage environments.

Application Example 2

In the method for maintaining an ink jet recording apparatus of Application Example 1, an organic solvent with a reference boiling point of 170° C. or higher may be included as the organic solvent which is contained in the impregnation solution.

Application Example 3

In the method for maintaining an ink jet recording apparatus of Application Example 1 or 2, an organic solvent with a reference boiling point of 180° C. or higher may be included as the organic solvent which is contained in the solvent-based ink composition.

Application Example 4

In the method for maintaining an ink jet recording apparatus of any one of Application Examples 1 to 3, the total content of the organic solvent which is contained in the solvent-based ink composition may be 40 mass % or more with respect to the total mass of the solvent-based ink composition.

Application Example 5

In the method for maintaining an ink jet recording apparatus of any one of Application Examples 1 to 4, the wiping may be carried out using a wiping member which is impregnated with the organic solvent which is contained in the impregnation solution at 20 parts by mass or more with respect to 100 parts by mass of the wiping member.

Application Example 6

In the method for maintaining an ink jet recording apparatus of any one of Application Examples 1 to 5, the wiping member may be a fabric.

Application Example 7

In the method for maintaining an ink jet recording apparatus according to any one of Application Examples 1 to 6, the wiping member may be impregnated with the impregnation solution when shipped.

Application Example 8

According to another aspect of the invention, there is provided an ink jet recording apparatus in which maintenance is performed using the maintaining method according to any one of Application Examples 1 to 7.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description will be given below of some embodiments of the invention. The embodiments below describe an example of the invention. The invention is not limited to the embodiments below and includes various types of modifications carried out in a range which does not change the gist of the invention. Here, it is not the case that all of the configurations described below are essential configurations of the invention.

An "image" in the invention indicates a pattern which is formed by a dot group and the pattern also includes printing patterns, patterns such as pictures or designs, and solid patterns.

1. Maintaining Method

A method for maintaining (also simply referred to below as a "maintaining method") an ink jet recording apparatus which performs recording using a solvent-based ink composition which includes at least one type of organic solvent selected from a group consisting of an ester-based solvent, a hydrocarbon-based solvent, and an alcohol-based solvent according to an embodiment of the invention includes wiping a nozzle forming member, in which nozzles of a head which discharges a solvent-based ink composition are formed, using an impregnation solution and a wiping member with liquid absorbency, in which the impregnation solution contains at least one type of organic solvent selected from a group consisting of a compound which is represented by General Formula (1) below, esters, and dibasic acid esters.

$$R^1—O—(R^2—O)_n—R^3 \quad (1)$$

(In General Formula (1) described above, $R^1$ represents a hydrogen atom, an aryl group, or an alkyl group with 1 to 6 carbon atoms. $R^2$ represents an alkylene group with 2 to 4 carbon atoms. $R^3$ represents an aryl group or an alkyl group with 1 to 6 carbon atoms. n represents an integer of 1 to 9.)

Detailed description will be given below of the steps of the method for maintaining the ink jet recording apparatus according to the present embodiment after describing the apparatus configuration which is able to carry out the method, the impregnation solution, and the solvent-based ink composition in this order.

1.1. Apparatus Configurations

Figure 1:
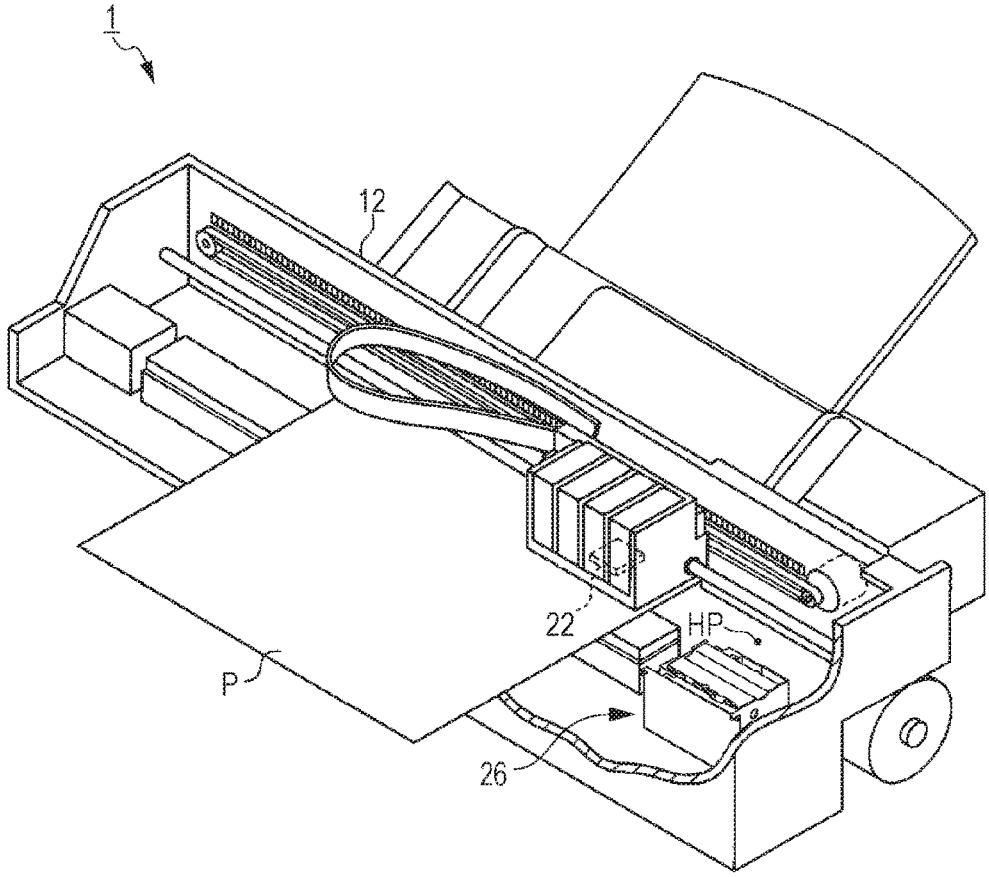
FIG. 1 is a diagram which schematically shows an ink jet recording apparatus according to an embodiment of the invention.

The ink jet recording apparatus which is able to carry out the maintaining method according to the present embodiment has a nozzle forming member in which nozzles which discharge a solvent-based ink composition are provided and a wiping member with liquid absorbency. Examples of the ink jet recording apparatus include the ink jet printer shown in FIG. 1. An ink jet printer 1 shown in FIG. 1 is an ink jet printer which is known in the art in which a head maintenance is assembled.

1.1.1. Nozzle Forming Member

Figure 2:
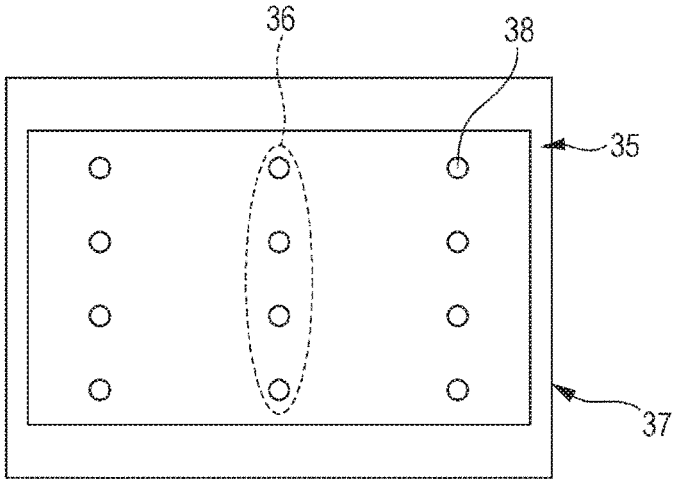
FIG. 2 is a schematic diagram which schematically shows a nozzle forming surface of the ink jet recording apparatus according to the embodiment of the invention.

A surface on which nozzles of a nozzle forming member (also referred to below as a "nozzle forming surface") are formed is installed at a position in a recording head 22 which opposes a recording medium P. FIG. 2 is a schematic diagram which schematically shows the nozzle forming surface. That is, FIG. 2 is a schematic diagram where the recording head 22 is viewed from the recording medium P side. As shown in FIG. 2, a plurality of nozzles (nozzle openings) 38 which discharge a solvent-based ink composition (which will be described below) are provided on a nozzle forming surface 37. A plurality of the nozzles 38 are arranged in a predetermined direction to configure a nozzle row 36. As shown in FIG. 2, a plurality of nozzle rows 36 may be provided on the nozzle forming surface 37.

A liquid-repellent film may be provided on the nozzle forming surface 37. The liquid-repellent film is not particularly limited as long as the film has liquid repellency and, for example, it is possible to form the film via a drying process, an annealing process, or the like after film-forming a molecular film of metal alkoxide having liquid repellency. The molecular film of metal alkoxide may be any film as long as the film has liquid repellency; however, a monomolecular film of metal alkoxide which has a long chain polymer group (a long chain RF group) which includes fluorine or a monomolecular film of a metallic acid salt which has a liquid-repellent group (for example, a long chain polymer group which includes fluorine) is desirable. The metal alkoxide is not particularly limited; however, as the metal, for example, silicon, titanium, aluminum, and zirconium are generally used. Examples of the long chain RF group include a perfluoroalkyl chain and a perfluoropolyether chain. Examples of alkoxysilane which has the long chain RF group include a silane coupling agent or the like which has a long chain RF group. The liquid-repellent film is not particularly limited and it is also possible to use, for example, a silane coupling agent (SCA) film or the film described in Japanese Patent No. 4,424,954. Here, in particular, films having water repellency are referred to as water-repellent films.

In addition, the liquid-repellent film may be formed on a conductive film after forming the conductive film on a substrate (a nozzle plate) on which nozzles are formed; however, the liquid-repellent film may be formed on a base film after film-forming the base film (a plasma polymerization silicon (PPSi) film) by plasma-polymerizing silicon materials beforehand. It is possible to make the liquid-repellent film conform to the silicon materials of the nozzle plate via the base film.

The liquid-repellent film preferably has a thickness of 1 nm to 30 nm, more preferably has a thickness of 1 nm to 20 nm, and particularly preferably has a thickness of 1 nm to 15 nm. By setting the thickness to the ranges described above, the nozzle forming surface has a tendency to be superior in liquid repellency, the deterioration of the film is comparatively slow, and it is possible to maintain the liquid repellency for longer periods. In addition, the cost and ease of film forming are also superior.

A nozzle plate cover 35 which covers at least a portion of the nozzle forming surface 37 may be provided on the nozzle forming surface 37. In the example in FIG. 2, the nozzle plate cover 35 is provided so as to surround all of the nozzle rows 36. On the nozzle forming surface of the head which is formed by a combination of a plurality of nozzle chips (simply referred to below as "chips"), the nozzle plate cover 35 is provided in order to fulfill at least one role out of fixing the chips or of preventing the recording medium from directly contacting the nozzles due to the recording medium being raised. Then, the nozzle plate cover 35 described above is provided in a state of protruding from the nozzles when viewed from the side surface by covering at least a portion of the nozzle forming surface 37. In a case where the nozzle plate cover 35 is provided, solvent-based ink compositions tend to remain at the corners (gaps) between the nozzle forming surface 37 and the nozzle plate cover 35 which protrudes therefrom and there are problems in that the adhesion of the cap and the nozzle forming surface 37 is not sufficient and the capping operation may be a failure due to the remaining solvent-based ink composition pigments and the like being solidified. The problem is particularly remarkable with some types of resins which are included in the solvent-based ink compositions. Thus, by bringing the wiping member in contact with between the nozzle plate cover 35 and the nozzle forming surface 37, it is possible to remove the solvent-based ink composition which is accumulated between the gaps described above and the capping operation is stable and favorable.

When carrying out the wiping step which will be described below, wiping is performed using an impregnation solution while attaching the impregnation solution to the nozzle forming member. In detail, examples thereof include a form where, when carrying out the wiping step, the impregnation solution is impregnated in the wiping member by attaching the impregnation solution to the nozzle forming member or the wiping member or both using a spraying apparatus or coating apparatus which is known in the art and then wiping the nozzle forming member using the wiping member, and a form where the impregnation solution is attached to the nozzle forming member by impregnating the impregnation solution in the wiping member beforehand and wiping the nozzle forming member using the wiping member which holds the impregnation solution.

1.1.2. Wiping Member

The wiping member is used for cleaning the nozzle forming surface by wiping the nozzle forming member and absorbing or adsorbing attached matter (for example, a solvent-based ink composition, an impregnation solution, fibers, paper, dust, and the like) which are attached to the nozzles and the nozzle forming surface. Due to this, since the attached matter which is attached to the nozzle forming surface is absorbed inside the wiping member, the attached matter does not remain on the surface of the wiping member. For this reason, it is possible to suppress damage to the water-repellent film (the nozzle forming surface) caused by the attached matter.

The wiping member is not particularly limited as long as the wiping member has liquid absorbency and examples thereof include fabrics (textiles, knitted material, non-woven textiles, and the like), sponges, pulps, and the like. Among these, fabrics are preferable. This is because fabrics are easily flexed and, in a case where a nozzle plate cover is provided, ink which is attached to the nozzle forming surface is more easily wiped off. The materials which form the fabric are not particularly limited; however, examples thereof include materials formed of cupra, polyester, polyethylene, polypropylene, lyocell, rayon, and the like. At this time, materials which are not easily deteriorated by the impregnation solution are preferably selected.

It is possible to appropriately set the thickness of the wiping member as desired and it is possible to set the thickness to be, for example, 0.1 mm to 3 mm or less. When the thickness is 0.1 mm or more, the impregnation solution is more easily held. When the thickness is 3 mm or less, the wiping member is compact, it is possible to miniaturize the entire maintenance unit, and mechanical transportation of the wiping member is also easier.

The surface density of the wiping member is preferably 0.005 g/cm$^2$ to 0.15 g/cm$^2$ or less and more preferably 0.02 g/cm$^2$ to 0.13 g/cm$^2$ or less. When the surface density of the wiping member is in the ranges described above, the impregnation solution is more easily held. Furthermore, in order to hold the impregnation solution, fabrics of which the surface density and thickness are easily altered are preferably used for the wiping member.

Wiping members impregnated with an impregnation solution at the time of shipping (that is, at the time of shipping a wiping member which is attached to an ink jet printer or a replacement wiping member) are preferable. Due to this, it is possible to immediately wipe the nozzle forming member after setting up the ink jet printer or replacing the wiping member. In addition, it is not necessary to provide the ink jet printer with a mechanism, which ejects or coats the impregnation solution on the nozzle forming member. Here, "an impregnation solution is impregnated at the time of shipping" refers to a state in which, when installing an ink jet recording apparatus which is provided with a wiping member, the impregnation solution is already impregnated in the wiping member, a state in which, when installing the wiping member in the ink jet recording apparatus, the impregnation solution is already impregnated in the wiping member, or a state in which the impregnation solution is impregnated in a replacement wiping member. Here, "installing an ink jet recording apparatus" refers to preparing the ink jet recording apparatus for first time use and "installing the wiping member" refers to preparing the wiping member for first time use. In the present embodiment, it is sufficient if the wiping of the nozzle forming member which is performed using the wiping member is wiping of the nozzle forming member using at least the wiping member.

1.1.3. Driving Mechanism

The ink jet recording apparatus which is used in the present embodiment may have a driving mechanism for performing the wiping step which will be described below. The driving mechanism is means for performing the step of wiping attached matter which is attached to the nozzle forming member using the wiping member by relatively moving at least one of the wiping member and the recording head with respect to the other. The driving mechanism preferably has a pressing member which relatively presses the wiping member and the nozzle forming member at 50 gf to 500 gf (preferably 75 gf to 300 gf). By the pressing force being 50 gf or more, the cleanness is more favorable. Furthermore, even in a case where there is a level difference between the nozzle plate and the nozzle plate cover, the driving mechanism is excellent at preventing ink from being attached to or accumulating in gaps or at removing ink from the gaps. In addition, by the pressure being 500 gf or less, the storage property of the liquid-repellent film is superior. The driving mechanism is not particularly limited; however, it is possible to bring the wiping member in contact with the nozzle forming member by pressing the wiping member from the opposite side to the side which is in contact with the nozzle forming member. In addition, it is also possible to bring the wiping member in contact with the nozzle forming member by driving the recording head. Here, the load referred to here is the total load which is applied by the entire driving mechanism to the nozzle forming member.

Furthermore, the driving mechanism preferably relatively moves the wiping member and the recording head at a speed of 1 cm/s to 10 cm/s. By setting the speed to the range described above, the cleanness and the storage property of the liquid-repellent film are further improved. Here, the speed of the cleaning operation is as slow as approximately one fifth to one twentieth of the speed at which the recording head normally records images; however, the invention is not limited to this speed relationship.

The pressing member is not particularly limited; however, the pressing member is preferably covered by an elastic member. The Shore A hardness of the elastic member is preferably 10 to 60 and more preferably 10 to 50. Due to this, the pressing member and the wiping member are flexed when pressed and it is possible to push the wiping member far into the depths of the uneven surface formed of the nozzle forming surface. In particular, in a case where there is a nozzle plate cover, it is possible to push the wiping member into the depths of the corners (gaps) between the nozzle forming surface and the nozzle plate cover which protrudes therefrom and it is possible to suppress inks from accumulating. As a result, the cleanness is further improved.

1.2. Impregnation Solution

The method for maintaining the ink jet recording apparatus according to the present embodiment uses an impregnation solution. The impregnation solution is supplied to the nozzle forming member when carrying out at least the wiping step which will be described below. In detail, the impregnation solution may be supplied and attached to the nozzle forming member using a spraying apparatus and the like which is known in the art when carrying out the wiping step or may be attached to the nozzle forming member by being impregnated in the wiping member when carrying out the wiping step.

Detailed description will be given below of components which may be included in the impregnation solution.

1.2.1. Organic Solvent

The impregnation solution which is used in the present embodiment contains at least one type of an organic solvent (also referred to below as a "first specific organic solvent") selected from a group consisting of a compound which is represented by General Formula (1) below, esters, and dibasic acid esters. The first specific organic solvent may be used as one type individually or two or more types may be used together. Since the first specific organic solvent has an excellent effect of dissolving (softening) a solvent-based ink composition which is attached to the nozzle forming member, it is possible to suppress the aggregation of components which are included in the solvent-based ink composition and it is also possible to improve the cleanness of the nozzle forming member.

Compound which is represented by General Formula (1)

$$R^1—O—(R^2—O)_n—R^3 \quad (1)$$

In General Formula (1) described above, $R^1$ represents a hydrogen atom, an aryl group, or an alkyl group with 1 to 6 carbon atoms. $R^2$ represents an alkylene group with 2 to 4 carbon atoms. $R^3$ represents an aryl group or an alkyl group with 1 to 6 carbon atoms. n represents an integer of 1 to 9.

Examples of the "aryl group" in $R^1$ and $R^3$ include a phenyl group, a benzyl group, a tolyl group, a xylyl group, a naphthyl group, a methylnaphthyl group, a benzylphenyl group, a biphenyl group, and the like. In addition, it is possible for the "alkyl group with 1 to 6 carbon atoms" in $R^1$ and $R^3$ to be a straight-chain or branched alkyl group and examples thereof include a methyl group, an ethyl group, an n-propyl group, an iso-propyl group, an n-butyl group, a sec-butyl group, a tert-butyl group, a pentyl group, a hexyl group, and the like. Examples of the "alkylene group with 2 to 4 carbon atoms" in $R^2$ include an ethylene group, an n-propylene group, an isopropylene group, a butylene group, and the like.

In General Formula (1) described above, $R^1$ is preferably a hydrogen atom or an alkyl group with 2 to 4 carbon atoms. In addition, in General Formula (1) described above, $R^3$ is preferably an alkyl group with 2 to 4 carbon atoms. Due to this, the effect of dissolving (softening) a solvent-based ink composition is improved and the cleanness is more favorable.

In General Formula (1) described above, n is preferably an integer of 3 to 6. Due to this, the effect of dissolving (softening) a solvent-based ink composition is improved and the cleanness is more favorable.

Specific examples of the compound which is represented by General Formula (1) described above include glycol ethers such as alkylene glycol monoether and alkylene glycol diether. It is possible to use the glycol ethers as one type individually or in a mixture of two or more types.

Examples of alkylene glycol monoethers include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, diethylene glycol monobenzyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, dipropylene glycol monoethyl ether, and the like.

Examples of alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethylmethyl ether, diethylene glycol dibutyl ether, diethylene glycol butylmethyl ether, triethylene glycol dimethyl ether, triethylene glycol diethyl ether, triethylene glycol dibutyl ether, triethylene glycol butylmethyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and the like.

Esters

Examples of esters (R—CO—OR') include an organic solvent where R is a hydrogen atom, an alkyl group, an aryl group, or a glycol ether group and R' is an alkyl group or an aryl group. Glycol ether esters are preferably used as the esters and examples thereof include ethylene glycol monomethyl ether acetate, ethylene glycol monoethyl ether acetate, ethylene glycol monopropyl ether acetate, ethylene glycol monobutyl ether acetate, propylene glycol monomethyl ether acetate, propylene glycol monoethyl ether acetate, propylene glycol monopropyl ether acetate, propylene glycol monobutyl ether acetate, diethylene glycol monomethyl ether acetate, diethylene glycol monoethyl ether acetate, diethylene glycol monopropyl ether acetate, diethylene glycol monobutyl ether acetate, dipropylene glycol monomethyl ether acetate, dipropylene glycol monoethyl ether acetate, dipropylene glycol monopropyl ether acetate, dipropylene glycol monobutyl ether acetate, triethylene glycol monomethyl ether acetate, triethylene glycol monoethyl ether acetate, triethylene glycol monopropyl ether acetate, triethylene glycol monobutyl ether acetate, tripropylene glycol monomethyl ether acetate, tripropylene glycol monoethyl ether acetate, tripropylene glycol monopropyl ether acetate, tripropylene glycol monobutyl ether acetate, 3-methoxybutyl acetate, 3-methoxy-3-methyl-1-butyl acetate, and the like.

Dibasic Acid Esters

Examples of dibasic acid esters include monoesters, diesters, and the like of dicarboxylic acid (for example, aliphatic dicarboxylic acid such as glutaric acid, adipic acid, and succinic acid). In detail, examples thereof include dimethyl-2-methyl glutarate, and the like.

Among the first specific organic solvents described above, from the point of view of having an excellent effect of dissolving (softening) a solvent-based ink composition, the compound which is represented by General Formula (1) described above is preferably used.

As the first specific organic solvent described above, a solvent with a reference boiling point of 170° C. or higher is preferably used, a solvent with a reference boiling point of 210° C. or higher is more preferably used, and a solvent with a reference boiling point of 250° C. or higher is particularly preferably used. The upper limit value thereof is preferably 450° C. or lower, more preferably 400° C. or lower, even more preferably 350° C. or lower, and particularly preferably 250° C. or lower. Since it is possible to reduce the generation of nozzle clogging which accompanies the drying of the impregnation solution by using a first specific organic solvent of which a reference boiling point is in the ranges described above, the discharge stability of the solvent-based ink composition is more favorable. In addition, since it is possible to suppress the nozzle forming member from drying in the wiping step which will be described below, in particular, the scratch resistance also improves in the nozzle forming surface.

For the first specific organic solvents described above, a solvent of which the vapor pressure at 20° C. is 1 hPa or less is preferably used, a solvent of which the vapor pressure is 0.5 hPa or less is more preferably used, a solvent of which the vapor pressure is 0.1 hPa or less is even more preferably used, and a solvent of which the vapor pressure is 0.01 hPa or less is particularly preferably used. Since it is possible to reduce the generation of nozzle clogging which accompanies the drying of the impregnation solution by using a first specific organic solvent of which the vapor pressure is in the ranges described above, the discharge stability of the solvent-based ink composition tends to be favorable.

In addition, as the first specific organic solvent described above, an organic solvent of which the surface tension at 20° C. is 25 mN/m to 35 mN/m is preferably used. Due to this, since the mutual solubility with the solvent-based ink composition which will be described below is improved, the cleanness has a tendency to be further improved. Here, it is possible to measure the surface tension by confirming the surface tension when a platinum plate is wetted with an organic solvent in a 20° C. environment using an Automatic surface tensiometer CBVP-Z (manufactured by Kyowa Interface Science Co., Ltd.).

The lower limit value of the content of the first specific organic solvent in the impregnation solution is preferably 30 mass % or more with respect to the total mass (100 mass %) of the impregnation solution, and more preferably 50 mass % or more. By the content of the first specific organic solvent being 30 mass % or more, the cleanness of the nozzle forming member is further improved. The upper limit value of the content of the first specific organic solvent in the impregnation solution is not particularly limited and the content may be 100 mass %.

In a case of performing the wiping step which will be described below using a wiping member which is impregnated with an impregnation solution, the content ratio of the impregnation solution which is impregnated in the wiping member is preferably 20 parts by mass or more of the first specific organic solvent with respect to 100 parts by mass of the wiping member, more preferably 40 parts by mass or more, and particularly preferably 50 parts by mass or more.

The upper limit value thereof is preferably 150 parts by mass or less, and more preferably 100 parts by mass or less. By the first specific organic solvent being 20 parts by mass or more, it is possible to further dissolve (soften) the solvent-based ink composition which is attached to the nozzle forming member and solidified, the cleanness is excellent, and the cleanness when left for long periods is also favorable. By the first specific organic solvent being 150 parts by mass or less, since the solvent-based ink composition is easily absorbed in the wiping member, discharge abnormalities or defective discharges due to wiped ink residue do not easily occur and the discharge stability of the ink is favorable.

The impregnation solution which is used in the present embodiment may contain an organic solvent other than the first specific organic solvent described above. Examples of such organic solvents include organic solvents which are exemplified in the solvent-based ink compositions which will be described below.

1.2.2. Other Components

It is possible to further add substances for adding predetermined performances such as surfactants, pH adjusting agents, chelating agents, preservative agents, antifungal agents, and rust preventing agents to the impregnation solution which is used in the present embodiment.

1.3. Solvent-Based Ink Composition

The ink jet recording apparatus to which the method for maintaining according to the present embodiment is applied records images on a recording medium using a solvent-based ink composition which contains at least one type of organic solvent selected from a group consisting of ester-based solvents, hydrocarbon-based solvents, and alcohol-based solvents.

In the invention, a "solvent-based ink composition" is an ink which has an organic solvent as the main solvent and which does not have water as the main solvent. The water content in the ink is preferably 3 mass % or less, more preferably 1 mass % or less, even more preferably less than 0.05 mass %, even more preferably less than 0.01 mass %, yet more preferably less than 0.005 mass %, and most preferably less than 0.001 mass %. Alternatively, the ink may substantially not contain water. "Substantially does not contain" indicates that water is not deliberately contained. In a case of including other components than organic solvents such as coloring materials or resins, it is possible to set the content of the organic solvent in the solvent-based ink composition to be the remainder after the other components are excluded, for example, it is possible to set the content of the organic solvent to be 70 mass % or more or even 80 mass % or more and it is possible to set the upper limit of the content to 100 mass % or less or even 99 mass % or less.

While there are advantages in that the solvent-based ink composition is able to form images which are excellent in water resistance and that the dryness is excellent when attached to a recording medium with low absorbency as a result of having the organic solvent as the main solvent, there are problems in that the solvent-based ink composition is easily attached to a nozzle forming member and is not easily removed. With respect to these problems, by using the impregnation solution described above to wipe the nozzle forming material to which the solvent-based ink composition is attached, it is easy to maintain a state in which there is no attached matter on the nozzle forming member due to the effect of the impregnation solution.

Detailed description will be given below of components which may be included in the solvent-based ink composition.

1.3.1. Organic Solvent

The solvent-based ink composition which is used in the present embodiment contains at least one type of organic solvent (also referred to below as a "second specific organic solvent") selected from a group consisting of an ester-based solvent, a hydrocarbon-based solvent, and an alcohol-based solvent. By containing the second specific organic solvent, it is possible to improve the permeability of the ink with respect to plain paper. In addition, since the dryness is excellent, it is possible to improve the dryness of the recorded image and it is possible to, for example, suppress the generation of curling in plain paper, the transfer of dirt onto the recorded matter by a roller, and the like.

In addition, since the second specific organic solvent has a characteristic of affinity with the first specific organic solvent which is included in the impregnation solution described above, it is possible to suppress aggregated matter from being generated by the impregnation solution and the solvent-based ink composition being mixed in the wiping step which will be described below.

Ester-Based Solvent

Examples of ester-based solvents include methyl acetate, ethyl acetate, n-propyl acetate, isopropyl acetate, n-butyl acetate, isobutyl acetate, isopentyl acetate, sec-butyl acetate, amyl acetate, methoxybutyl acetate, methyl lactate, ethyl lactate, butyl lactate, methyl capryate, methyl laurate, lauryl acid isopropyl, isopropyl myristate, isopropyl palmitate, isooctyl palmitate, isostearyl palmitate, methyl oleate, ethyl oleate, isopropyl oleate, butyl oleate, methyl linoleate, isobutyl linoleate, ethyl linoleate, isopropyl isostearate, soybean oil methyl, soybean oil isobutyl, tall oil methyl, tall oil isobutyl, diisopyl adipate, diisopropyl sebacate, diethyl sebacate, propylene glycol monocaprate, tris(2-ethylhexanoic acid) trimethylolpropane, tris(2-ethylhexanoic acid) glyceryl, ethylene glycol monomethyl ether acetate, ethylene glycol monoethyl ether acetate, propylene glycol monomethyl ether acetate, propylene glycol monoethyl ether acetate, diethylene glycol monomethyl ether acetate, diethylene glycol monoethyl ether acetate, diethylene glycol monobutyl ether acetate, and the like.

Hydrocarbon-Based Solvent

Examples of hydrocarbon-based solvents include aliphatic hydrocarbons (for example, paraffin and isoparaffin), alicyclic hydrocarbons (for example, cyclohexane, cyclooctane, cyclodecane, and the like), aromatic hydrocarbons (for example, benzene, toluene, xylene, naphthalene, tetraphosphorus, and the like), and the like. Commercially available products may be used as the hydrocarbon-based solvent and examples thereof include aliphatic hydrocarbon or alicyclic hydrocarbons such as IP Solvent 1016, IP Solvent 1620, and IP Clean LX (the above are all product names, produced by Idemitsu Kosan Co., Ltd.), Isopar G, Isopar L, Isopar H, Isopar M, Exxsol D40, Exxsol D80, Exxsol D100, Exxsol D130, and Exxsol D140 (the above are all product names, produced by Exxon Corporation), NS Clean 100, NS Clean 110, NS Clean 200, and NS Clean 220 (the above are all product names, produced by JX Nippon Oil & Energy Corporation), Naphtesol 160, Naphtesol 200, and Naphtesol 220 (the above are all product names, produced by JX Nippon Oil & Energy Corporation), or aromatic hydrocarbons such as Solvesso 200 (product name, produced by Exxon Corporation).

Alcohol-Based Solvent

Examples of alcohol-based solvents include methanol, ethanol, isopropanol, 1-propanol, 1-butanol, 2-butanol, 3-pentanol, 2-methyl-1-butanol, 2-methyl-2-butanol, isoamyl alcohol, 3-methyl-2-butanol, 3-methoxy-3-methyl-1-butanol, 4-methyl-2-pentanol, allyl alcohol, 1-hexanol, 1-heptanol, 2-heptanol, 3-heptanol, isomyristyl alcohol, isopalmityl alcohol, isostearyl alcohol, oleyl alcohol, and the like.

The lower limit value of the total content of the second specific organic solvent which is included in the solvent-based ink composition which is used in the present embodiment is preferably 40 mass % or more with respect to the total mass (100 mass %) of the solvent-based ink composition, more preferably 50 mass % or more, and particularly preferably 70 mass % or more. In addition, the upper limit value is preferably 100 mass % or less, and more preferably 95 mass % or less. By the total content of the second specific organic solvent being 40 mass % or more, it is possible to improve the dryness of the recorded image and it is possible to effectively suppress the generation of curling in plain paper, the transfer of dirt onto the recorded matter by a roller, and the like. In addition, it is possible to effectively prevent aggregation which is generated by mixing with the impregnation solution.

The reference boiling point of the second specific organic solvent which is included in the solvent-based ink composition is preferably 180° C. or higher. The upper limit value thereof is preferably 450° C. or lower, more preferably 400° C. or lower, even more preferably 350° C. or lower, and particularly preferably 250° C. or lower. Since it is possible to prevent dryness of the solvent-based ink composition in a discharge head by the reference boiling point being 180° C. or higher, the discharge stability from the discharge head is favorable. In addition, by the reference boiling point being 450° C. or lower, the balance between dryness and dryness resistance of ink is favorable.

The solvent-based ink composition which is used in the present embodiment may contain an organic solvent other than the second specific organic solvent described above. Examples of such organic solvents include cyclic lactone, glycol ethers, and the like.

Cyclic Lactone

The solvent-based ink composition which is used in the present embodiment preferably also contains cyclic lactone. By containing cyclic lactone, in particular, it is possible to impregnate the solvent-based ink composition inside a recording medium with low absorbency (for example, a vinyl chloride-based resin) by dissolving a portion of the recording medium. The solvent-based ink composition being impregnated inside the recording medium in this manner makes it possible to improve the scratch resistance of images which are recorded on the recording medium.

The "recording medium with low absorbency" in the present specification refers to a recording medium of which the amount of water absorption from the start of contact to $msec^{1/2}$ is 10 $mL/m^2$ or less according to the Bristow method and it is sufficient if at least the recording surface is provided with this characteristic. According to this definition, a non-absorbent recording medium which does not absorb water at all is also included in the "recording medium with low absorbency" in the invention. The Bristow method is the most widely used method for measuring the amount of liquid absorption in a short time and is also adopted by the Japan Technical Association of the Pulp and Paper Industry (JAPAN TAPPI). The details of the testing methods are described in "Paper and Cardboard-Liquid Absorbency Testing Methods-Bristow Method" which is specification No. 51 in "JAPAN TAPPI Paper Pulp Testing Methods 2000".

Examples of recording media with low absorbency specifically include sheets, films, fiber products, and the like which include materials with low absorbency. In addition, the recording medium with low absorbency may be provided with a layer (also referred to below as a "layer with low absorbency") which includes materials with low absorbency on a surface of a substrate (for example, paper, fiber, leather, plastic, glass, ceramics, metal, or the like). The materials with low absorbency are not particularly limited; however, examples thereof include olefin-based resins, ester-based resins, urethane-based resins, acryl-based resins, vinyl chloride-based resins, and the like.

The "cyclic lactone" in the invention collectively refers to cyclic compounds which have an ester group (—CO—O—) in a ring. The cyclic lactone is not particularly limited as long as the cyclic lactone fits the definition described above; however, a lactone with 2 to 9 carbon atoms is preferable. Specific examples of the lactone include α-ethyl lactone, α-acetolactone, β-propiolactone, γ-butyrolactone, δ-valerolactone, ϵ-caprolactone, ζ-enantiolactone, η-caprylolactone, γ-valerolactone, γ-heptalactone, γ-nonalactone, β-methyl-δ-valerolactone, 2-butyl-2-ethyl propiolactone, α,α-diethyl propiolactone, and the like; however, γ-butyrolactone is particularly preferable among the above. It is possible to use the exemplified cyclic lactones described above as one type individually or in a mixture of two or more types.

In a case of containing a cyclic lactone, the content thereof is preferably 1 mass % or more with respect to the total mass of the solvent-based ink composition, more preferably 5 mass % or more, and particularly preferably 10 mass % or more. The upper limit value is preferably 40 mass % or less, more preferably 30 mass % or less, and particularly preferably 20 mass % or less. The scratch resistance of the image has a tendency to be further improved by the content of the cyclic lactone being 1 mass % or more. On the other hand, by the content of the cyclic lactone being 40 mass % or less, the glossiness of the image has a tendency to be improved.

Glycol Ethers

The solvent-based ink composition which is used in the present embodiment preferably also contains glycol ethers. Containing glycol ethers makes it possible to control the wettability or permeation speed with respect to the recording medium. Examples of glycol ethers include alkylene glycol monoethers, alkylene glycol diethers, and the like. It is possible to use the glycol ethers as one type individually or in a mixture of two or more types.

Examples of alkylene glycol monoethers include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, dipropylene glycol monomethyl ether, dipropylene glycol monoethyl ether, and the like.

Examples of alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethylmethyl ether, diethylene glycol dibutyl ether, diethylene glycol butylmethyl ether, triethylene glycol dimethyl ether, triethylene glycol diethyl ether, triethylene glycol dibutyl ether, triethylene glycol butylmethyl ether, tetraethylene glycol dimethyl ether, tetraethylene glycol diethyl ether, tetraethylene glycol dibutyl ether, propylene glycol dimethyl ether, propylene glycol dimethyl ether, dipropylene glycol dimethyl ether, dipropylene glycol diethyl ether, and the like.

In a case where glycol ethers are contained, the content is preferably 5 mass % to 30 mass % with respect to the total mass of the solvent-based ink composition, and more preferably 10 mass % to 25 mass %. There is a tendency for the glossiness or dot size of the image to be favorable when the content of glycol ethers is 5 mass % or more and there is a tendency for it to be possible to reduce the generation of printing unevenness in the image when the content is 30 mass % or less.

1.3.2. Coloring Material

Dye may be used as a coloring material and it is also possible to use pigments such as inorganic pigments and organic pigments; however, pigments are preferably used from the point of view of light resistance and the like. The coloring materials may be used as one type individually or may be used in a mixture of two or more types.

Examples of the organic pigment include azo pigments (for example, azo lake, insoluble azo pigments, condensed azo pigments, chelate azo pigments, and the like), polycyclic pigments (phthalocyanine pigments, perylene and perylene pigments, anthraquinone pigments, quinacridone pigments, dioxanezine pigments, thioindigo pigments, isoindolinone pigments, quinophthalone pigments, and the like), dye lakes (for example, basic dye type lakes, acidic dye type lakes, and the like), nitro pigments, nitroso pigments, aniline black, daylight fluorescent pigments, and the like. In addition, examples of inorganic pigments include carbon black, titanium dioxide, silica, alumina, and the like.

It is possible to appropriately set the content of the coloring material as desired without being particularly limited; however, the content is normally 0.1 mass % to 10 mass % with respect to the total mass of the solvent-based ink composition.

In addition, in a case of using a pigment as a coloring material, the dispersibility of the pigment in ink is preferably also improved by using a pigment dispersing agent. Examples of pigment dispersing agents include polyester-based polymer compounds such as Hinoact KF1-M, T-6000, T-7000, T-8000, T-8350P, and T-8000E (the above are all produced by Takefu Fine Chemicals Co., Ltd.), Solsperse 20000, 24000, 32000, 32500, 33500, 34000, 35200, and 37500 (the above are all produced by Lubrizol Corporation), Disperbyk-161, 162, 163, 164, 166, 180, 190, 191, 192, 2091, and 2095 (the above are all produced by BYK Japan KK), Florene DOPA-17, 22, 33, and G-700 (the above are all produced by Kyoeisha Chemical Co., Ltd.), Ajisper PB821 and PB711 (the above are all produced by Ajinomoto Co., Inc.), LP4010, LP4050, LP4055, Polymer 400, 401, 402, 403, 450, 451, and 453 (the above are all produced by EFKA Chemicals Co., Ltd.), and the like. It is possible to set the content in a case of using a pigment dispersing agent as appropriate according to the pigment to be contained; however, the content is preferably 5 parts by mass to 200 parts by mass with respect to the content 100 parts by mass of the pigment in the solvent-based ink composition, and more preferably 30 parts by mass to 120 parts by mass.

1.3.3. Resin

The solvent-based ink composition which is used in the present embodiment may contain a resin (also referred to below as a "fixing resin") for fixing the coloring material described above to the recording medium.

Examples of fixing resins include acryl resins, styrene acryl resins, rosin-modified resins, phenol resins, terpene resins, polyester resins, polyamide resins, epoxy resins, vinyl acetate resins, vinyl chloride resins, fiber-based resins such as cellulose acetate butyrate, vinyltoluene-α-methyl styrene copolymer resins, and the like. Among these, at least one type of resin selected from a group consisting of an acryl resin and a vinyl chloride resin is preferable, and a vinyl chloride resin is more preferable. By containing the fixing resin described above, it is possible to improve the fixing property to the recording medium and, moreover, the scratch resistance is also improved.

The content of the solid content of the fixing resin in the solvent-based ink composition which is used in the present embodiment is preferably 0.05 mass % to 15 mass %, and more preferably 0.1 mass % to 10 mass %. When the content of the fixing resin is in these ranges, it is possible to obtain an excellent fixing property with respect to the recording medium.

Acryl Resin

It is possible to use a copolymer formed of polymerizable monomers which are known in the art as an acryl resin. As the polymerizable monomers, other than acrylate esters such as methyl acrylate, ethyl acrylate, isopropyl acrylate, n-butyl acrylate, and 2-ethylhexyl acrylate; methacrylate esters such as methyl methacrylate, ethyl methacrylate, isopropyl methacrylate, n-butyl methacrylate, isobutyl methacrylate, t-butyl methacrylate, cyclohexyl methacrylate, and 2-ethylhexyl methacrylate; and carboxy group-containing monomers such as acrylic acid, methacrylic acid, maleic acid, fumaric acid, itaconic acid, mono n-butyl maleate, mono n-butyl fumarate, and itaconic acid mono n-butyl, it is possible to use hydroxyl group-containing (meth)acrylate esters, amide group-containing monomers, glycidyl group-containing monomers, cyano group-containing monomers, hydroxyl group-containing allyl compounds, tertiary amino group-containing monomers, alkoxysilyl group-containing monomers, and the like individually or in a combination of a plural thereof.

Commercially available products may be used as the acryl resin and examples thereof include Acrypet MF (product name, produced by Mitsubishi Rayon Co., Ltd., acryl resin), Sumipex LG (product name, produced by Sumitomo Chemical Co., Ltd., acryl resin), Paraloid B series (product name, produced by Rohm & Haas Company, acryl resin), Parapet G-1000P (product name, produced by Kuraray Co., Ltd., acryl resin), and the like. Here, in the present specification, "(meth)acrylic acid" has the meaning of both acrylic acid and methacrylic acid and "(meth)acrylate" has the meaning of both acrylate and methacrylate.

Vinyl Chloride Resin

Examples of the vinyl chloride resin include copolymers of vinyl chloride and other monomers such as vinyl acetate, vinylidene chloride, acrylic acid, maleic acid, and vinyl alcohol; however, among these, copolymers (also referred to below as "hydrochloric acid vinyl copolymers") which include a configuration unit which are derived from vinyl chloride and vinyl acetate are preferable, and hydrochloric acid vinyl copolymers of which the glass transition temperature is 60° C. to 80° C. are more preferable.

It is possible to obtain hydrochloric acid vinyl copolymers using a typical method and it is possible to obtain the hydrochloric acid vinyl copolymers, for example, by suspension polymerization. In detail, it is possible to perform suspension polymerization by preparing and degassing water, a dispersing agent, and a polymerization initiator in a polymerization container, and then pressing vinyl chloride and vinyl acetate therein, or to perform suspension polymerization by starting a reaction by pressing in a portion of the vinyl chloride and vinyl acetate and then pressing in the remaining vinyl chloride during reaction.

The hydrochloric acid vinyl copolymer preferably contains a vinyl chloride unit at 70 mass % to 90 mass % as the composition thereof. In the range described above, since the hydrochloric acid vinyl copolymer is stably dissolved in a solvent-based ink composition, the long-term storage stability is excellent. Furthermore, discharge stability is excellent and it is possible to obtain an excellent fixing property with respect to the recording medium.

In addition, the hydrochloric acid vinyl copolymers may be provided with another configuration unit along with a vinyl chloride unit and a vinyl acetate unit as necessary, and examples thereof include a carboxylic acid unit, a vinyl alcohol unit, and a hydroxyalkyl acrylate unit, and particularly preferable examples include a vinyl alcohol unit. It is possible to obtain the hydrochloric acid vinyl copolymer by using monomers which correspond to each of the units described above. Specific examples of the monomers which impart a carboxylic acid unit include maleic acid, itaconic acid, maleic anhydride, itaconic anhydride, acrylic acid, and methacrylic acid. Specific examples of monomers which impart a hydroxyalkyl acrylate unit include hydroxyethyl (meth)acrylate, hydroxyethyl vinyl ether, and the like. The content of the monomers is not limited as long as the effects of the invention are not lost; however, it is possible to carry out copolymerization, for example, in a range of 15 mass % or less of the total amount of the monomers.

In addition, commercially available hydrochloric acid vinyl copolymers may be used and examples thereof include Solbin CN, Solbin CNL, Solbin C5R, Solbin TA5R, Solbin CL, and Solbin CLL (the above are all produced by Nissin Chemical Industry Co., Ltd.), Kanevinyl HM515 (produced by Kaneka Corporation), and the like.

The average polymerization degree of the resins is not particularly limited, but is preferably 150 to 1100 and more preferably 200 to 750. In a case where the average polymerization degree of the resins is in the ranges described above, since the resin is stably dissolved in the solvent-based ink composition which is used in the present embodiment, the long-term storage stability is excellent. Furthermore, discharge stability is excellent and it is possible to obtain an excellent fixing property with respect to the recording medium. Here, the specific viscosity is measured and the average polymerization degree of the resins is calculated therefrom and it is possible to obtain the average polymerization degree on the basis of the average polymerization degree calculation method described in "JIS K6720-2".

In addition, the number average molecular weight of the resins is not particularly limited, but is preferably 10000 to 50000, and more preferably 12000 to 42000. Here, it is possible to measure the number average molecular weight by GPC, and it is possible to obtain the number average molecular weight as a relative value according to polystyrene conversion.

1.3.4. Surfactant

From the point of view of improving wettability with a recording medium by reducing the surface tension, a silicon-based surfactant, a fluorine-based surfactant, or a polyoxyethylene derivative which is a non-ionic surfactant may be added to the solvent-based ink composition which is used in the present embodiment.

Polyester modified silicon or polyether modified silicon is preferably used as the silicon-based surfactant. Specific examples thereof include BYK-315, 315N, 347, 348, BYK-UV 3500, 3510, 3530, and 3570 (the above are all produced by BYK Japan KK).

A fluorine modified polymer is preferably used as the fluorine-based surfactant and specific examples thereof include BYK-340 (produced by BYK Japan KK).

In addition, an acetylene glycol-based surfactant is preferably used as the polyoxyethylene derivative. Specific examples thereof include Surfynol 82, 104, 465, 485, and TG (the above are all produced by Air Products and Chemicals, Inc.), Olfin STG and E1010 (the above are all produced by Nissin Chemical Industry Co., Ltd.), Nissan nonion A-10R and A-13R (the above are all produced by NOF Corporation), Florene G-740W and D-90 (the above are all produced by Kyoeisha Chemical Co., Ltd.), Noigen CX-100 (produced by Dai-ichi Kogyo Seiyaku Co., Ltd.), and the like.

The content of the surfactant in the solvent-based ink composition which is used in the present embodiment is preferably 0.05 mass % to 3 mass %, and more preferably 0.5 mass % to 2 mass %.

1.3.5. Other Components

It is possible to add substances for adding predetermined performances such as pH adjusting agents, chelating agents such as ethylenediamine tetraacetate (EDTA), preservative agents, antifungal agents, and rust preventive agents to the solvent-based ink composition which is used in the present embodiment as necessary.

1.3.6. Method for Preparing Solvent-Based Ink Composition

The solvent-based ink composition which is used in the present embodiment is obtained by mixing the components described above in an arbitrary order and removing impurities by filtering or the like as necessary. As a method for mixing each of the components, a method in which materials are added to a container which is provided with a stirring apparatus such as a mechanical stirrer and a magnetic stirrer in order and then stirred and mixed is favorably used. As the filtering method, it is possible to perform centrifugal filtration, filter filtration, and the like as necessary.

1.3.7. Properties of Solvent-Based Ink Composition

From the point of view of the balance between recording quality and reliability as ink for ink jet recording, the surface tension of the solvent-based ink composition which is used in the present embodiment at 20° C. is preferably 20 mN/m to 50 mN/m, and more preferably 25 mN/m to 40 mN/m. Here, it is possible to measure the surface tension by confirming the surface tension when wetting a platinum plate with ink in a 20° C. environment using an Automatic surface tensiometer CBVP-Z (produced by Kyowa Interface Science Co., Ltd.).

In addition, from the same point of view, the viscosity of the solvent-based ink composition at 20° C. is preferably 2 mPa·s to 15 mPa·s or less, and more preferably 2 mPa·s to 10 mPa·s or less. Here, it is possible to measure the viscosity by increasing the Shear Rate to 10 to 1000 in a 20° C. environment and reading the viscosity at a Shear Rate of 200 using a viscoelastic testing machine MCR-300 (produced by Pysica Corporation).

1.4. Wiping Step of Maintaining Method

The method for maintaining the ink jet recording apparatus according to the present embodiment is provided with a step of wiping a nozzle forming member to which the impregnation solution described above is supplied using a wiping member. Since the nozzle forming member is wiped using the impregnation solution described above in the wiping step, the cleanness of the nozzle forming member is excellent.

Figure 3:
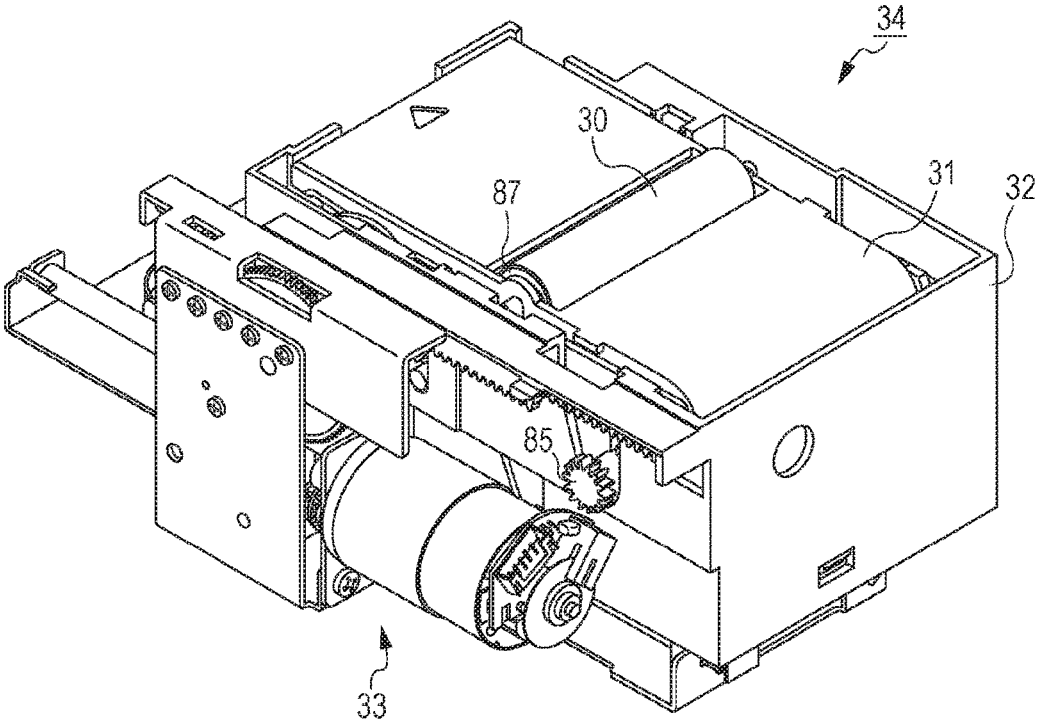
FIG. 3 is a perspective diagram which schematically shows a wiper unit of the ink jet recording apparatus according to the embodiment of the invention.
Figure 4A:
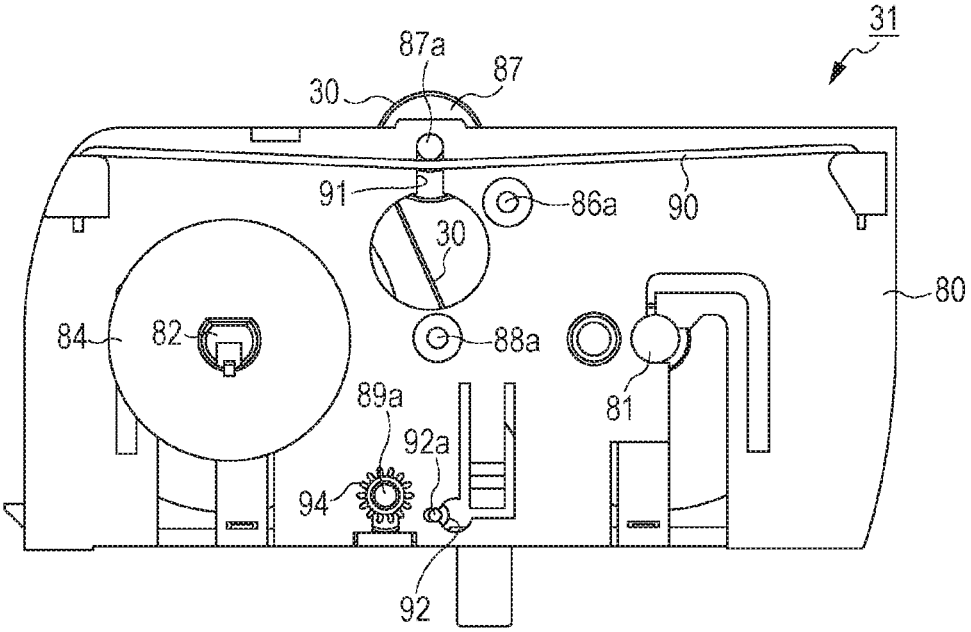
FIGS. 4A and 4B are front surface diagrams which schematically show a wiper unit of the ink jet recording apparatus according to the embodiment of the invention.

Detailed description will be given below of an example of the wiping step with reference to diagrams. FIG. 3 is a perspective diagram which schematically shows a wiper unit 34 which is an example of the head maintenance apparatus 26. FIG. 4A is a front surface diagram of the wiper unit 34 and FIG. 4B is a front surface diagram of the wiper unit 34 of which the housing is omitted.

As shown in FIG. 1, the head maintenance apparatus for maintaining the recording head 22 is provided at a home position HP which is provided on the right side of a recording region to which recording paper P is transported in a frame 12.

The head maintenance apparatus 26 has the wiper unit 34 formed of a wiper unit 31 on which a wiping member 30 which wipes a solvent-based ink composition from a nozzle forming member of the recording head 22 is mounted, a wiper holder 32 on which the wiper unit 31 is mounted so as to be able to be freely attached and detached, and a moving mechanism 33 which moves the wiper holder 32 in a nozzle row direction of the recording head 22 (the transport direction of the recording medium in FIG. 1). Here, other than the wiper unit 34, the head maintenance apparatus 26 may be provided with a cap (which is omitted in the diagram) which is provided so as to be able to come in contact so as to surround nozzles with respect to the nozzle forming member of the recording head 22 and a suction pump (which is omitted in the diagram) which is driven in order to draw in and discharge solvent-based ink composition which is thickened or the like from the recording head 22 via the cap as waste ink. Here, the driving mechanism according to the present embodiment is a mechanism for pressing the wiping member which includes an impregnation solution and the nozzle forming surface of the nozzle forming member and is formed of at least a pressing member 87 and a spring rod 90 in FIG. 4A, and the moving mechanism 33 may also be included.

Figure 4B:
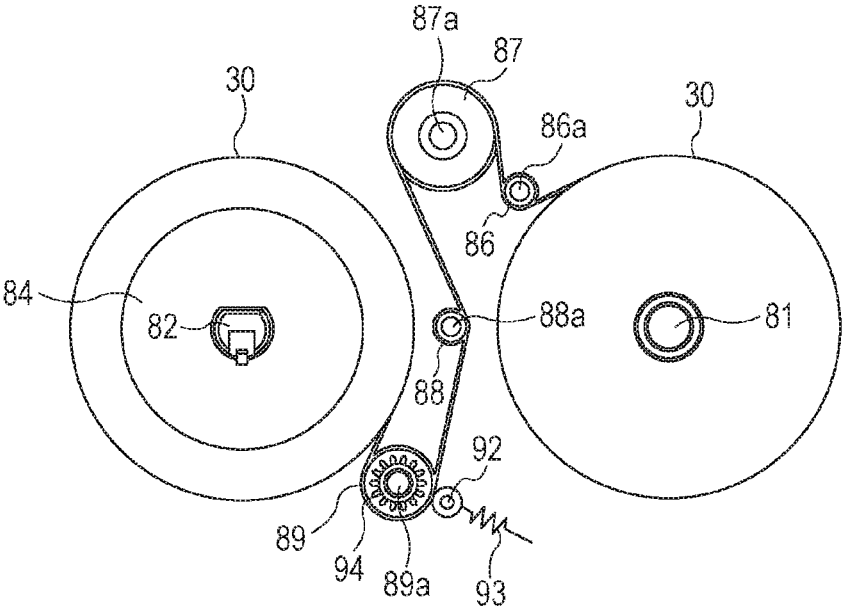

As shown in FIGS. 4A and 4B, inside a housing 80 which has a substantially rectangular box shape which configures the exterior of the wiper unit 31, a pair of rollers 81 and 82 which have axes which extend horizontally in the front and back direction which is the lateral direction of the housing 80 are accommodated at intervals in the right and left direction which is the longitudinal direction of the housing 80. The long wiping member 30 for wiping ink from the nozzle forming surface of the recording head 22 is hung between the pair of the rollers 81 and 82. Then, in the pair of the rollers 81 and 82, as a first roller which is provided on the left side which is near the recording region in which the recording head 22 carries out recording with respect to recording paper (recording medium) P, the feeding roller 81 feeds the rolled and unused wiping member 30. On the other hand, in the pair of the rollers 81 and 82, as a second roller on the right side which is near the opposite side to the recording region in which the recording head 22 carries out recording with respect to recording paper P, the winding roller 82 winds in the wiping member 30 which was used for wiping from the feeding roller 81. Here, the feeding roller 81 and the winding roller 82 are positioned at substantially the same height as each other. In addition, a feeding gear is provided on an end section (a front end section) in the axis direction of the feeding roller 81 which is exposed to the outside of the housing 80 so as to be able to integrally rotate with the feeding roller 81. In addition, winding gears 84 and 85 are provided on both end sections in the axis direction of the winding roller 82 which are exposed on the outside of the housing 80 so as to be able to integrally rotate with the winding roller 82.

In addition, in the housing 80, a plurality (4 in the present embodiment) of rollers 86, 88, and 89 and the pressing member 87 are provided on the feeding path of the wiping member 30 from the feeding roller 81 to the winding roller 82. The rollers 86, 88, and 89 and the pressing member 87 extend to the front and back in parallel with the feeding roller 81 and the winding roller 82 and both ends in the front and back direction are supported so as to be able to freely rotate by a bearing section or the like provided in a side wall section of the housing 80.

In detail, a portion which is fed from the feeding roller 81 in the wiping member 30 is wound onto the pressing member 87 which is provided diagonally upward and to the right upper portion of the feeding roller 81. A shaft section 87*a* at both ends in the axis direction in the pressing member 87 is supported from below by the spring rod 90 which is fixed to the outside surface on both sides of the front and back of the housing 80. The spring rod 90 supports the shaft section 87*a* of the pressing member 87 from below at an intermediate position in the longitudinal direction thereof. Here, the shaft section 87*a* of the pressing member 87 is inserted in a bearing hole 91 which is provided in the housing 80 and is adhered to a hole edge on the upper side of the bearing hole 91 in accordance with upward force which is imparted thereto from the spring rod 90. Then, the shaft section 87*a* of the pressing member 87 is supported so as to be able to freely rotate from both the upper and lower sides between the spring rod 90 and the hole edge of the bearing hole 91. In addition, the uppermost section of the peripheral surface in the pressing member 87 is positioned above the upper surface of the housing 80 and the portion which is wound onto the pressing member 87 in the wiping member 30 protrudes upward from the upper surface of the housing 80. In addition, the uppermost section of the peripheral surface in the pressing member 87 is positioned above the nozzle forming surface of the recording head 22.

The driving mechanism of the present embodiment which includes at least the spring rod 90 and the pressing member 87 is able to impart a pressing load by pressing the wiping member 30 which includes an impregnation solution with respect to the nozzle forming surface 37 according to upward force from the spring rod 90. The pressing load of the present embodiment refers to the spring load. Here, regarding the mechanism which applies the pressing load, as long as it is possible to press the wiping member on the nozzle forming surface with a certain load, rubber may also be used as well as springs, or the load may be applied using a method such as applying a load by electrically controlling a mechanical member without using these.

In addition, a relay roller 89 which winds a portion which is fed from the pressing member 87 in the wiping member 30 is provided in the vertically lower portion of the pressing member 87. In addition, a holding roller 92 which holds the wiping member 30 between itself and the relay roller 89 is provided in a position on the opposite side to the relay roller 89 interposing the wiping member 30. In addition, a spring member 93 is interposed as a biasing member between the bottom wall inner surface of the housing 80 and the holding roller 92. Then, the holding roller 92 is biased by the spring member 93 in a direction which approaches the relay roller 89.

Here, a relay gear 94 is provided in an end section of a shaft section 89*a* of one side (the rear side in FIGS. 4A and 4B) in the axis direction which is exposed to the outside from the side wall section of the housing 80 in the relay roller 89 to be able to integrally rotate with the relay roller 89. In addition, shaft sections 92*a* at both ends in the holding roller 92 in the axis direction have end sections exposed to the outside from a bearing section in a cut out groove which is formed when cutting out and forming an elastic piece section in the side wall section of the housing 80.

In addition, tension rollers 86 and 88 which impart tension to the wiping member 30 are provided between the feeding roller 81 and the pressing member 87 and between the pressing member 87 and the relay roller 89 on the feeding path of the wiping member 30 from the feeding roller 81 to the winding roller 82. Here, shaft sections 86*a* and 88*a* at both ends in the axis direction in the tension rollers 86 and 88 have end sections exposed to the outside from a circular concave bearing section which is provided in the side wall section of the housing 80.

The maintaining method according to the present embodiment is also favorably used in an ink jet recording apparatus which records images by heating a recording medium to 30° C. or higher (more preferably 35° C. to 50° C. or lower). Nozzle clogging caused by heating easily occurs in such ink jet recording apparatuses; however, it is possible to effectively suppress the generation of defects such as nozzle clogging since the step of wiping using the impregnation solution described above is carried out in the method for maintaining according to the present embodiment.

2. Examples

More detailed description will be given below of the invention using Examples and Comparative Examples; however, the invention is not limited only to these Examples. Here, unless otherwise stated, "parts" and "%" in the Examples and Comparative Examples are based on mass.

2.1. Evaluation of Ink Composition

2.1.1. Preparation of Ink Composition

After mixing and sufficiently stirring each component so as to form the compositions in Table 1, each ink composition was obtained by carrying out filtration using a 5 μm membrane filter made of PTFE. Here, inks 1 to 7 are solvent-based ink compositions and ink 8 is a water-based ink composition.

Here, in the components which are used in Table 1, the components which are described other than with compound names are as follows.

Coloring Material

PB-15:3 (C.I. Pigment blue 15:3)

Pigment Dispersing Agent

Solsperse 37500 (product name, produced by Lubrizol Corporation)

Solsperse 20000 (product name, produced by Lubrizol Corporation)

Ester-Based Solvent

PGmME-AC (propylene glycol monomethyl ether acetate)

Hydrocarbon-Based Solvent

Naphtesol 160 (product name, produced by JX Nippon Oil & Energy Corporation, a naphthene-based solvent)

Cyclic Lactone

GBL (γ-butyrolactone)

Glycol Ether-Based Solvent

DEGBME (diethylene glycol butylmethyl ether)

Tetra EGmBE (tetraethylene glycol monobutyl ether)

Surfactant

BYK 340 (product name, produced by BYK Japan KK, a fluorine-based surfactant)

BYK 331 (product name, produced by BYK Japan KK, a silicon-based surfactant)

Resin

HM515 (product name "Kanevinyl HM515", produced by Kaneka Corporation, a vinyl chloride-vinyl acetate copolymer)

SF-470 (product name "Superflex 470", produced by Dai-ichi Kogyo Seiyaku Co., Ltd., a water-based polyurethane resin)

2.1.2. Evaluation Test of Ink Composition

For the evaluation tests of the ink compositions, the environmental test lab was adjusted so as to be a predetermined temperature and humidity using an air conditioner and a humidifier and a modified ink jet printer "SC-S30650" (product name, manufactured by Seiko Epson Corporation) installed in the environmental test lab was used. In detail, an ink jet printer in which the head maintenance apparatus 26 (refer to FIG. 1 and the like) was assembled was used.

For each evaluation, recording was performed while heating using a heater such that the recording side surface temperature of the recording medium reached a predetermined temperature using a platen of the printer described above in which a heater was provided. Here, the temperature and the humidity were measured using a temperature and humidity sensor which was installed on housing which was not affected by heat of the ink jet printer itself such as a heater.

Aggregation Unevenness

Solid patterns with a recording resolution of 720×720 dpi were recorded with each ink composition at 100% concentration on a PVC banner sheet (manufactured by 3M Japan Ltd., model number IJ51 (polyvinyl chloride)) of which the surface temperature was set to 30° C. using the printer described above. The recorded matter was dried at 25° C. and 65% RH (relative humidity) for 24 hours. After that, the aggregation unevenness was evaluated by visually observing the recorded surface of the recorded matter. The evaluation criteria were as follows.

A: There was no bleeding in end sections of the pattern and there was no aggregation unevenness inside the pattern.

B: Bleeding was observed in end sections of the pattern but there is no aggregation unevenness inside the pattern.

C: A little aggregation unevenness was observed inside the pattern.

D: A lot of aggregation unevenness was observed inside the pattern.

Scratch Resistance

Solid patterns with a recording resolution of 720×720 dpi were recorded with each ink composition at 100% concentration on a PVC banner sheet (manufactured by 3M Japan Ltd., model number IJ51 (polyvinyl chloride)) of which the surface temperature was set to 30° C. using the printer described above. The recorded matter was dried at 25° C. and 65% RH (relative humidity) for one day. Subsequently, a drying test was performed in an I type testing machine on the basis of JIS L0849. After that, the scratch resistance was evaluated by measuring the OD of the test cotton cloth using Spectorino (manufactured by GretagMacbeth Corporation). The evaluation criteria were as follows.

A: 0.1 or less

B: More than 0.1 and 0.2 or less

C: More than 0.2 and 0.3 or less

D: More than 0.3

Dryness

Solid patterns with a recording resolution of 720×720 dpi were recorded with each ink composition at 100% concentration on a PVC banner sheet (manufactured by 3M Japan Ltd., model number IJ51 (polyvinyl chloride)) of which the surface temperature was set to 30° C. using the printer described above. The recorded matter was dried at 25° C. for 5 minutes. Subsequently, scratch marks were observed on the recording surface after being wound using a winding apparatus. In the observation, the ratio of the area in which there were scratch marks was calculated by measuring the surface roughness using a laser microscope (manufactured by Keyence Corporation, model type VK-8700 Generation 2).

The evaluation criteria were as follows.

A: The area of the scratch marks was 10% or less of the printing region.

B: The area of the scratch marks was more than 10% to 20% or less of the printing region.

C: The area of the scratch marks was more than 20% of the printing region.

Discharge Stability

After confirming normal discharge from 360 nozzles and the nozzle plate was opened at 25° C. 65% RH for 1 hour, and then the discharge condition of the nozzles was inspected. The evaluation criteria were as follows.

A: There were 2 or fewer discharge defects (discharge abnormalities or flight curvature).

B: There were 3 to 5 discharge defects.

C: There were 6 or more discharge defects.

2.1.3. Evaluation Results of Ink Composition

The compositions of each ink composition and the results of the evaluation tests are shown in Table 1 below.

TABLE 1

| Ink Composition Type | | Reference Boiling Point (° C.) | Ink 1 | Ink 2 | Ink 3 | Ink 4 | Ink 5 | Ink 6 | Ink 7 | Ink 8 |
|---|---|---|---|---|---|---|---|---|---|---|
| Coloring material | PB-15:3 | — | 4 | 4 | 4 | 4 | 4 | 4 | 4 | 4 |
| Pigment dispersion | Solsperse 37500 | — | 4 | 4 | 4 | 4 | 4 | 4 | 4 | — |
| | Solsperse 20000 | — | — | — | — | — | — | — | — | 4 |
| Ester based solvents | PGmME-AC | 146 | 42 | 57 | 32 | — | 15 | 42 | 25 | — |
| | Ethyl lactate | 155 | — | — | 21 | 47 | — | — | — | — |
| | Methyl caprylate | 188-193 | 10 | 5 | — | — | 25 | 10 | 5 | — |
| Alcohol based solvent | 3-methoxy-3-methyl-1-butanol | 174 | 21 | 14 | — | 16 | 5 | 21 | 5 | — |
| Hydrocarbon based solvent | Naphtesol 160 | 157-179 | — | — | 15 | 10 | — | — | — | — |
| Other solvents | GBL | 204 | 5 | — | 20 | 15 | 15 | 5 | — | 10 |
| | DEGBME | 212 | 10 | 12 | — | — | 28 | 10 | 53 | 15 |
| | TetraEGmBE | 300 | — | — | — | — | — | — | — | 10 |
| Surfactants | BYK340 | — | 2 | 2 | 2 | 2 | 2 | 2 | 2 | — |
| | BYK331 | — | — | — | — | — | — | — | — | 2 |
| Resins | HM515 | — | 2 | 2 | 2 | 2 | 2 | 2 | 2 | — |
| | SF-470 | — | — | — | — | — | — | — | — | 2 |
| Ion Exchange Water | | — | — | — | — | — | — | — | — | 53 |
| Total | | | 100 | 100 | 100 | 100 | 100 | 100 | 100 | 100 |
| Second Specific Organic Solvent Total Content (mass %) | | | 73 | 76 | 68 | 73 | 45 | 73 | 35 | 0 |
| Evaluation Results | Aggregation Unevenness | | B | A | A | B | C | B | C | D |
| | Scratch Resistance | | B | B | B | A | B | B | C | D |
| | Dryness | | B | A | A | B | B | B | C | C |
| | Discharge Stability | | A | A | B | B | A | A | A | C |

As shown in Table 1, it is understood that the solvent-based ink compositions (inks 1 to 7) are excellent in terms of the aggregation unevenness, scratch resistance, and surface dryness of the recorded image compared to the water-based ink composition (ink 8) and are also favorable in terms of discharge stability.

2.2. Preparation of Impregnation Solution

Impregnation solutions 1 to 14 were obtained by mixing and sufficiently stirring each component at the blending amounts shown in Table 2 below.

TABLE 2

| Impregnation Solution Type | | Impregnation Solution 1 | Impregnation Solution 2 | Impregnation Solution 3 | Impregnation Solution 4 | Impregnation Solution 5 | Impregnation Solution 6 | Impregnation Solution 7 | Impregnation Solution 8 |
|---|---|---|---|---|---|---|---|---|---|
| Compound represented by General Formula (1) | Triethylene glycol monobutyl ether | 99.5 | — | — | — | — | — | — | — |
| | Tetraethylene glycol monobutyl ether | — | 99.5 | — | — | — | — | — | — |
| | Pentaethylene glycol monobutyl ether | — | — | 99.5 | — | — | — | — | — |
| | Ethylene glycol monophenyl ether | — | — | — | 99.5 | — | — | — | — |
| | Diethylene glycol monobenzyl ether | — | — | — | — | 99.5 | — | — | — |
| | Diethylene glycol diethyl ether | — | — | — | — | — | 99.5 | — | — |
| | Diethylene glycol methyl ethyl ether | — | — | — | — | — | — | 99.5 | — |
| | Dipropylene glycol mono methyl ether | — | — | — | — | — | — | — | 99.5 |
| | Diethylene glycol mono butyl ether | — | — | — | — | — | — | — | — |
| | Tetraethylene glycol mono butyl ether | — | — | — | — | — | — | — | — |
| Ester type | Diethylene glycol mono ethyl ether acetate | — | — | — | — | — | — | — | — |
| Dibasic acid ester | Dimethyl-2-methyl glutarate | — | — | — | — | — | — | — | — |
| Other solvents | Polyethylene glycol (Mw: 200) | — | — | — | — | — | — | — | — |
| | Dipropylene glycol | — | — | — | — | — | — | — | — |
| Surfactant | Olefin E1010 | 0.5 | 0.5 | 0.5 | 0.5 | 0.5 | 0.5 | 0.5 | 0.5 |
| Total | | 100 | 100 | 100 | 100 | 100 | 100 | 100 | 100 |

| Impregnation Solution Type | | Impregnation Solution 9 | Impregnation Solution 10 | Impregnation Solution 11 | Impregnation Solution 12 | Impregnation Solution 13 | Impregnation Solution 14 |
|---|---|---|---|---|---|---|---|
| Compound represented by General Formula (1) | Triethylene glycol monobutyl ether | — | — | — | — | — | — |
| | Tetraethylene glycol monobutyl ether | — | — | — | — | — | — |
| | Pentaethylene glycol monobutyl ether | — | — | — | — | — | — |
| | Ethylene glycol monophenyl ether | — | — | — | — | — | — |
| | Diethylene glycol monobenzyl ether | — | — | — | — | — | — |
| | Diethylene glycol diethyl ether | — | — | — | — | — | — |
| | Diethylene glycol methyl ethyl ether | — | — | — | — | — | — |
| | Dipropylene glycol mono methyl ether | — | — | — | — | — | — |
| | Diethylene glycol mono butyl ether | 99.5 | — | — | — | — | — |
| | Tetraethylene glycol mono butyl ether | — | 99.5 | — | — | — | — |
| Ester type | Diethylene glycol mono ethyl ether acetate | — | — | 99.5 | — | — | — |
| Dibasic acid ester | Dimethyl-2-methyl glutarate | — | — | — | 99.5 | — | — |
| Other solvents | Polyethylene glycol (Mw: 200) | — | — | — | — | 99.5 | — |
| | Dipropylene glycol | — | — | — | — | — | 99.5 |
| Surfactant | Olefin E1010 | 0.5 | 0.5 | 0.5 | 0.5 | 0.5 | 0.5 |
| Total | | 100 | 100 | 100 | 100 | 100 | 100 |

Here, in the components which are used in Table 2, the components which are described other than with compound names are as follows.

Olfin E1010 (product name, produced by Nissin Chemical Industry Co., Ltd., an acetylene glycol-based surfactant)

2.3. Evaluation of Maintaining method 2.3.1. Wiping Conditions

Evaluation of the wiping was performed according to the wiping conditions shown in Table 3 below and Table 4 below. Here, cellulose long fiber non-woven fabric was used as the "fabric" (product name "Bemliese") and an impregnation solution was impregnated therein. On the other hand, a fluorine-based elastomer was used for a "blade wiper". Regarding the wiping operation, the wiping member (fabric or a blade wiper) was brought in contact with a nozzle plate (a nozzle forming surface) and the wiping member was moved by 20 cm in one direction with respect to the nozzle plate in a direction intersecting with the direction of a nozzle row in which nozzles were lined up in a state of being pressed by a pressing member from the rear of the wiping member to the nozzle plate. The wiping member was in the form of a roll and a new portion was drawn and used for the next wiping.

2.3.2. Wiping Evaluation Test

Cleanness

The ink compositions which were prepared as described above were set in a printer and continuous printing was carried out for 10 minutes. In the continuous printing, the surface temperature of the recording medium when the ink composition was discharged was set to be 30° C. Subsequently, a wiping operation (the wiping step) for wiping a nozzle forming surface was performed according to the wiping conditions shown in Table 3 below and Table 4 below. The operations up to here were one set and 50 sets were repeatedly performed. After completion, dirt on the nozzle plate and the foreign matter residue state were visually observed. The evaluation criteria were as follows.

A: Dirt (ink wiping residue, foreign matter, and the like) were not observed.

B: A little dirt was observed in parts such as the vicinity of end sections of the nozzle plate.

C: Dirt was observed over the entire nozzle plate.

Mixing Test (Aggregation)

The impregnation solution and the ink composition which were used in each example were mixed at a mass ratio of 1:5 and sealed in a glass container and it was visually confirmed whether or not any aggregated matter was generated after being left at 40° C. for 7 days. The evaluation criteria were as follows.

A: Aggregation was not observed.

B: Aggregation was observed.

Long-Term Cleanness

The same cleanness test as described above was performed except that a wiping member which was left at a normal temperature for 1 month after an impregnation solution was impregnated therein was used. The evaluation criteria were as follows.

A: Dirt (ink wiping residue, foreign matter, and the like) was not observed.

B: A little dirt was observed in parts such as the vicinity of end sections of the nozzle plate.

C: Dirt was observed over the entire nozzle plate.

2.3.3. Maintaining Method Evaluation Results

Evaluation conditions and evaluation results regarding the maintaining method are shown in Table 3 below and Table 4 below.

TABLE 3

| | | Examples | | | | | | | |
|---|---|---|---|---|---|---|---|---|---|
| | | 1 | 2 | 3 | 4 | 5 | 6 | 7 | 8 |
| Composition Type | Ink Composition | Ink 1 | Ink 1 | Ink 1 | Ink 1 | Ink 1 | Ink 1 | Ink 1 | Ink 1 |
| | Impregnation Solution | Impregnation Solution 1 | Impregnation Solution 2 | Impregnation Solution 3 | Impregnation Solution 4 | Impregnation Solution 5 | Impregnation Solution 6 | Impregnation Solution 7 | Impregnation Solution 8 |
| Impregnation Conditions | Amount of impregnation solution with respect to 100 parts by mass of wiping member | 30 | 30 | 30 | 30 | 30 | 30 | 30 | 30 |
| Evaluation Results | Cleaning properties | A | A | A | A | A | A | A | A |
| | Mixing Test | A | A | A | A | A | A | A | A |
| | Long term cleaning property | A | A | A | A | A | B | B | B |

| | | Examples | | | | Comparative Examples | |
|---|---|---|---|---|---|---|---|
| | | 9 | 10 | 11 | 12 | 1 | 2 |
| Composition Type | Ink Composition | Ink 1 | Ink 1 | Ink 1 | Ink 1 | Ink 1 | Ink 1 |
| | Impregnation Solution | Impregnation Solution 9 | Impregnation Solution 10 | Impregnation Solution 11 | Impregnation Solution 12 | Impregnation Solution 13 | Impregnation Solution 14 |
| Impregnation Conditions | Amount of impregnation solution with respect to 100 parts by mass of wiping member | 30 | 30 | 30 | 30 | 30 | 30 |

TABLE 3-continued

| | | | | | | | |
|---|---|---|---|---|---|---|---|
| Evaluation Results | Cleaning properties | A | A | A | A | C | C |
| | Mixing Test | A | A | A | A | B | B |
| | Long term cleaning property | A | A | A | A | C | C |

TABLE 4

| | | Examples | | | | | |
|---|---|---|---|---|---|---|---|
| | | 13 | 14 | 15 | 16 | 17 | 18 |
| Composition Type | Ink Composition | Ink 1 | Ink 1 | Ink 2 | Ink 3 | Ink 4 | Ink 5 |
| | Impregnation Solution | Impregnation Solution 1 | Impregnation Solution 1 | Impregnation Solution 1 | Impregnation Solution 1 | Impregnation Solution 1 | Impregnation Solution 1 |
| Impregnation Conditions | Amount of impregnation solution with respect to 100 parts by mass of wiping member | 20 | 100 | 30 | 30 | 30 | 30 |
| Evaluation Results | Cleaning properties | B | A | A | A | A | A |
| | Mixing Test | — | — | A | A | A | A |
| | Long term cleaning property | B | A | A | A | A | A |

| | | | Examples | | Comparative Examples | | |
|---|---|---|---|---|---|---|---|
| | | | 19 | 20 | 3 | 4 | 5 |
| Composition Type | Ink Composition | | Ink 6 | Ink 7 | Ink 8 | Ink 1 | Ink 1 |
| | Impregnation Solution | | Impregnation Solution 1 | Impregnation Solution 1 | Impregnation Solution 1 | — | Blade Wiper |
| Impregnation Conditions | Amount of impregnation solution with respect to 100 parts by mass of wiping member | | 30 | 30 | 30 | — | — |
| Evaluation Results | Cleaning properties | | A | A | C | C | C |
| | Mixing Test | | A | A | B | — | — |
| | Long term cleaning property | | A | A | C | C | C |

As shown in Table 3, it is understood that cleanness and long-term cleanness were favorable as a result of cleaning the nozzle forming surface using fabric in which an impregnation solution containing a first specific organic solvent was impregnated after recording with a solvent-based ink composition containing a second specific organic solvent. In addition, it is also understood that the impregnation solution containing the first specific organic solvent does not generate aggregated matter of the solvent-based ink composition containing the second specific organic solvent.

On the other hand, in Comparative Example 1 and Comparative Example 2, since wiping was performed using an impregnation solution which did not contain the first specific organic solvent, it is understood that the cleanness and the long-term cleanness dramatically decreased. In addition, it is also understood that the impregnation solution which does not contain the first specific organic solvent generates aggregation of the solvent-based ink composition which contains the second specific organic solvent.

In Comparative Example 3, it is understood that, in a case of recording using a water-based ink composition rather than a solvent-based ink composition, the cleanness and the long-term cleanness were not excellent even when cleaning the nozzle forming surface using fabric impregnated with the impregnation solution which contains the first specific organic solvent. In addition, it is also understood that aggregated matter was generated when the impregnation solution containing the first specific organic solvent was mixed with the water-based ink composition.

In addition, in Comparative Example 4, it is understood that, since an impregnation solution was not used, the cleanness and the long-term cleanness were dramatically decreased and the dried fabric damaged the nozzle forming surface. In Comparative Example 5, it is understood that, since the wiping was performed using a blade wiper which was not impregnated with an impregnation solution, the cleanness and the long-term cleanness were decreased and the nozzle forming surface was damaged.

The invention is not limited to the embodiments described above and various types of modifications are possible. For example, the invention includes configurations which are substantially the same (for example, configurations with the same functions, methods, and results or configurations with the same object and effects) as the configurations described in the embodiments. In addition, the invention includes configurations where portions of the configurations described in the embodiments which are not essential are substituted. In addition, the invention includes configurations which exhibit the same effects as the configurations described in the embodiments or configurations which are able to achieve the same object. In addition, the invention includes configurations in which techniques known in the art are added to the configurations described in the embodiments.

The entire disclosure of Japanese Patent Application No. 2015-046896, filed Mar. 10, 2015 is expressly incorporated by reference herein.

What is claimed is:

1. A method for maintaining an ink jet recording apparatus which performs recording using a solvent-based ink composition which includes a hydrocarbon-based solvent, the method comprising:

wiping a nozzle forming member, in which nozzles of a head which discharges the solvent-based ink composition are formed, using an impregnation solution and a wiping member with liquid absorbency, wherein the impregnation solution contains a compound which is represented by General Formula (1) below in a content that is 50% by mass or more with respect to a total mass of the impregnation solution, $$R^1—O—(R^2—O)_n—R^3 \quad (1)$$

(in General Formula (1) described above, $R^1$ represents a hydrogen atom, an aryl group, or an alkyl group with 1 to 6 carbon atoms, $R^2$ represents an alkylene group with 2 to 4 carbon atoms, $R^3$ represents an aryl group, a methyl group, an ethyl group, an n-propyl group, an iso-propyl group, an n-butyl group, a sec-butyl group, or a tert-butyl group, and n represents an integer of 1 to 9).

2. The method for maintaining an ink jet recording apparatus according to claim 1, wherein the organic solvent which is contained in the impregnation solution includes an organic solvent with a reference boiling point of 170° C. or higher.

3. The method for maintaining an ink jet recording apparatus according to claim 1, wherein the hydrocarbon-based solvent has a reference boiling point of 180° C. or higher.

4. The method for maintaining an ink jet recording apparatus according to claim 1, wherein the total content of the hydrocarbon-based solvent which is contained in the solvent-based ink composition is 40 mass % or more with respect to the total mass of the solvent-based ink composition.

5. The method for maintaining an ink jet recording apparatus according to claim 1, wherein the wiping is carried out using a wiping member which is impregnated with the organic solvent which is contained in the impregnation solution at 20 parts by mass or more with respect to 100 parts by mass of the wiping member.

6. The method for maintaining an ink jet recording apparatus according to claim 1, wherein the wiping member is a fabric.

7. The method for maintaining an ink jet recording apparatus according to claim 1, wherein the wiping member is impregnated with the impregnation solution when shipped.

8. An ink jet recording apparatus which is maintained by the maintaining method according to claim 1.

9. An ink jet recording apparatus which is maintained by the maintaining method according to claim 2.

10. An ink jet recording apparatus which is maintained by the maintaining method according to claim 3.

11. An ink jet recording apparatus which is maintained by the maintaining method according to claim 4.

12. An ink jet recording apparatus which is maintained by the maintaining method according to claim 5.

13. An ink jet recording apparatus which is maintained by the maintaining method according to claim 6.

14. An ink jet recording apparatus which is maintained by the maintaining method according to claim 7.

15. The method according to claim 1, wherein the organic solvent of the impregnation solution is a dibasic acid ester.

16. The method according to claim 1, wherein the organic solvent of the impregnation solution having the General Formula (1) is diethylene glycol monobenzyl ether.

* * * * *